US009392894B2

(12) United States Patent
Piccioni

(10) Patent No.: US 9,392,894 B2
(45) Date of Patent: Jul. 19, 2016

(54) GLASS BELL JAR FOR THE PROTECTION AND/OR STORAGE OF FOOD

(75) Inventor: Pier Francesco Piccioni, Castelsangiovanni (IT)

(73) Assignee: VETRERIA DI BORGONOVO S.P.A., Borgonovo Val Tidone (IT)

( * ) Notice: Subject to any disclaimer, the term of this patent is extended or adjusted under 35 U.S.C. 154(b) by 1125 days.

(21) Appl. No.: 12/198,142

(22) Filed: Aug. 26, 2008

(65) Prior Publication Data

US 2009/0173735 A1 Jul. 9, 2009

(30) Foreign Application Priority Data

Jan. 8, 2008 (IT) ..... PC20080001 U

(51) Int. Cl.

| | |
|---|---|
| ***B65D 1/42*** | (2006.01) |
| ***B65D 6/34*** | (2006.01) |
| ***B65D 8/08*** | (2006.01) |
| ***B65D 25/26*** | (2006.01) |
| ***B65D 53/06*** | (2006.01) |
| ***A47G 19/26*** | (2006.01) |

(52) U.S. Cl.

CPC ..... *A47G 19/26* (2013.01); *A47G 19/265* (2013.01)

(58) Field of Classification Search

CPC ..... E06B 2003/6258; A47G 19/26; A47G 19/265; A47G 2023/0691; B65D 25/24

USPC ..... 220/228, 378, 574, 802, 224; 215/234; 312/284

See application file for complete search history.

(56) References Cited

U.S. PATENT DOCUMENTS

| | | | | |
|---|---|---|---|---|
| 3,134,496 | A * | 5/1964 | Kehe | 215/352 |
| 3,419,240 | A * | 12/1968 | Santic | 220/632 |
| 4,053,295 | A * | 10/1977 | Miyauchi | 65/62 |
| 4,485,801 | A * | 12/1984 | Hodges et al. | 126/386.1 |
| 4,629,084 | A * | 12/1986 | Hackelsberger | 215/346 |
| 5,441,344 | A * | 8/1995 | Cook, III | 374/141 |
| 5,813,638 | A * | 9/1998 | Morris | 248/152 |
| 6,378,831 | B1 * | 4/2002 | Copeland, Jr. | 248/345.1 |

* cited by examiner

*Primary Examiner* — Fenn Mathew
*Assistant Examiner* — Andrew T Kirsch
(74) *Attorney, Agent, or Firm* — Young & Thompson

(57) ABSTRACT

A glass bell jar for the protection of food such as desserts, pies and the like, which is designed to be rested on a dish, also made of glass, so as to cover the food contained in the dish, includes a U-shaped structural section, made of a soft plastic material such as polypropylene or the like, fitted along the edge of the bell jar to cushion the impact between the dish and the bell jar when the latter is rested on the dish, to prevent direct contact between the two glass parts, and to guarantee better airtightness. The risk is avoided, that one or both parts from crack, with the danger that shards of glass could contaminate the food contained in it. Health risks are thus avoided, and the unpleasant sound caused by the impact between two glass parts is eliminated.

4 Claims, 2 Drawing Sheets

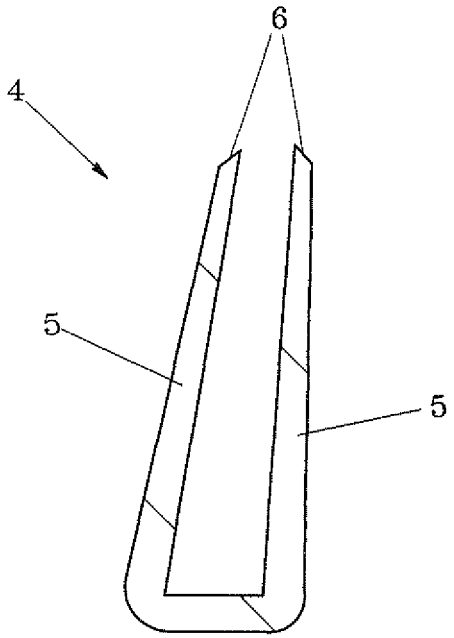
Fig. 3
Fig. 4
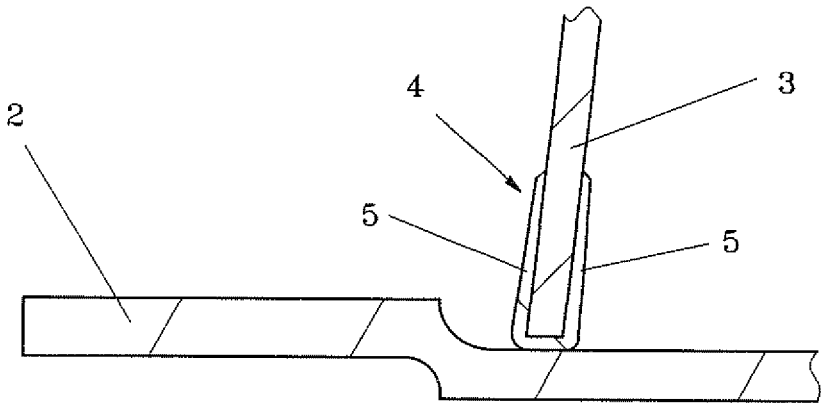

GLASS BELL JAR FOR THE PROTECTION AND/OR STORAGE OF FOOD

This invention relates to a glass bell jar for the protection and/or storage of food such as desserts, pies and the like, which is designed to be rested on a dish, also made of glass, so as to cover the food contained in said dish, characterised in that it includes means made of a soft material designed to cover the edge of said bell jar to prevent direct contact between the two glass parts, namely the dish and the bell jar, and to guarantee better airtightness.

In particular said means consist of a U-shaped structural section, made of a plastic material such as polypropylene or the like, fitted along the edge of the bell jar to cushion the impact between the dish and the bell jar when the latter is rested on the dish, to prevent one or both parts from cracking, with the danger that shards of glass could contaminate the food contained in it.

With the invention according to the invention, health risks are thus avoided, and the unpleasant sound caused by the impact between two glass parts is eliminated.

Moreover, as the edge is made of plastic and consequently deformable, better adherence is achieved between the surface of the dish and the bell jar, and the airtightness is improved, thus improving storage of the food. Glass bell jars designed to protect food have been available on the market for years. In particular these products comprise a base, consisting of a glass dish or tray, and a glass bell jar designed to be positioned above said base to cover and preserve the food inside it.

However, said objects made according to the prior art present some drawbacks.

Firstly, due to the fragility of the glass, the base or the bell jar may crack when the jar is placed on the base without sufficient care, and in any event the impact between the two glass parts generates a sound which is always unpleasant to the human ear.

Moreover, as both the bell jar and the base are practically indeformable, small gaps remain in the contact area between them which allow air and moisture to penetrate into the bell jar, thus partly reducing its protective effect.

To eliminate said problems with the prior art, the present invention offers a glass bell jar for food storage which is designed to be positioned on a glass dish or tray, characterised in that the edge of said bell jar is covered with a soft material to cushion the impact between the two glass parts and improve the airtightness of the bell jar.

This invention will now be described in detail, by way of example but not of limitation, by reference to the annexed figures wherein:

FIG. 3 is a cross-sectional view of the plastic structural section.

FIG. 4 is a cross-sectional view of the structural section applied to the edge of the bell jar.

FIG. 1 illustrates the bell jar, indicated as 1, and dish 2.

Figure 1:
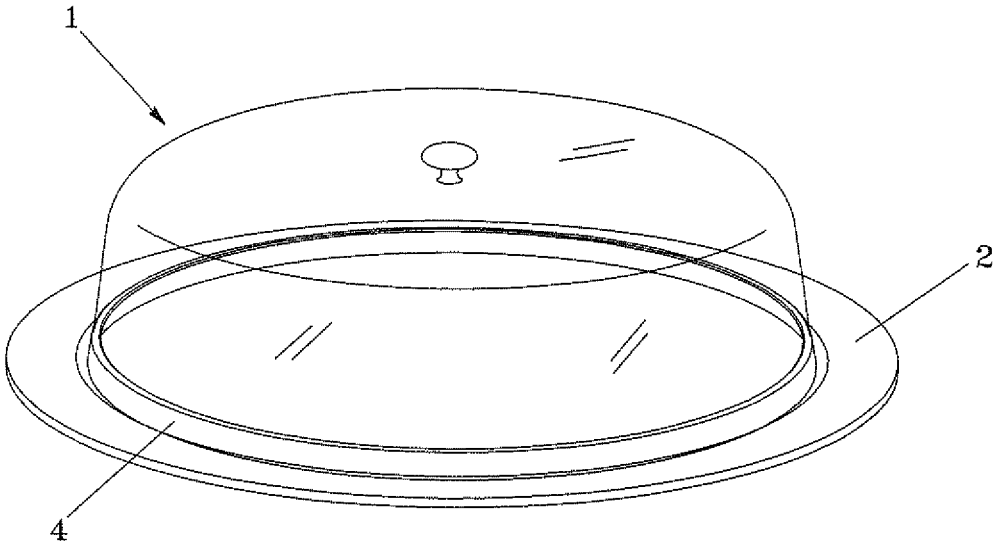
FIG. 1 is a perspective view of the bell jar resting on a dish, according to the invention.
Figure 2:
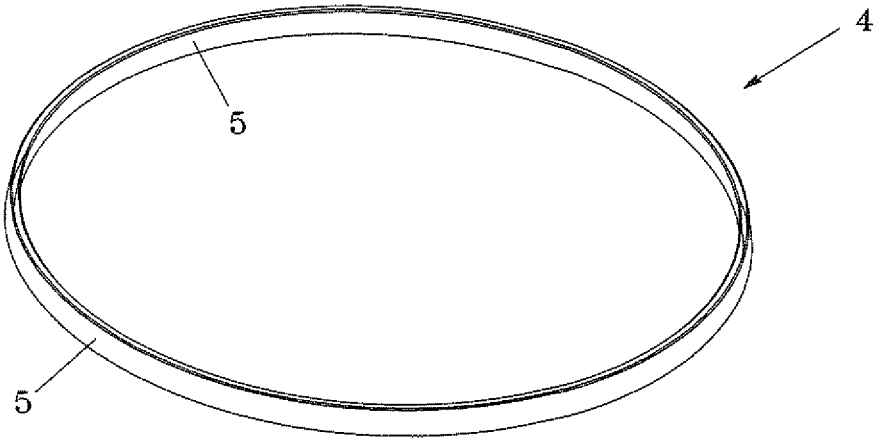
FIG. 2 is a perspective view of the plastic structural section.

The dish and bell jar are both made of glass.

A U-shaped structural section 4, made of plastic, such as polypropylene or the like, with walls 5 designed to adhere to the inner and outer surface of bell jar 1, is fitted to edge 3 of said bell jar.

Said walls 5 preferably have a variable thickness decreasing from the base to the ends, to guarantee better flexibility and consequently better adherence to said walls, thus facilitating the positioning and removal of the structural section from the bell jar for cleaning operations, for example.

Said U-shaped structural section is also made with walls 5 slightly converging, so that when the structural section is positioned on the edge, walls 5 are pushed slightly outwards, and the spring-back of the material can be exploited to keep said walls 5 adhering perfectly to edge 3, and prevent the structural section from becoming detached from the bell jar.

At the ends of walls 5 there are two bevels 6 which allow drops of water, such as condensation, to flow outside the structural section so that they do not end up between the edge of bell jar 3 and walls 5, with the risk of forming mould or other unhygienic compounds.

This invention consequently eliminates the problems of known objects with a solution that is both simple and effective.

Due to the presence of the edge made of soft material there is no longer any risk that the bell jar or the dish will crack, even if a more violent impact than usual is accidentally caused between the parts, and the problem of unpleasant noise typical of contact between glass parts is eliminated.

Moreover, as the edge is made of a deformable material it adheres perfectly to the surface of the dish, thus improving the airtightness of the bell jar to the benefit of storage of the food inside it.

Any modifications or variations shall be deemed to fall within the ambit of this invention.

The materials and dimensions can also vary, depending on the required use.

The invention claimed is:

1. A glass bell jar for the protection and/or storage of foods such as desserts and pies, designed to rest on a dish, substantially flat, so as to cover the food contained in said dish, said glass bell jar including:

a glass bell body having a lower edge; and means made of a soft material designed to cover the lower edge of said glass bell body so as to prevent said lower edge from coming into direct contact with the flat surface of the dish, whereby, when said glass bell jar rests on said dish, said means of a soft material are interposed between the lower edge of the glass bell body and the flat surface of the dish and are into direct contact with the dish, wherein said means consist of a U-shaped structural section that is provided with two side walls, made of a deformable plastic material, designed to adhere respectively to an inner and outer surface of the lower edge of the glass bell body, with each side wall of said two side walls having in section an elongated configuration extending linearly from a base, common to said two side walls, to a respective distal end of each side wall, wherein the cross-section of each side wall of the two side walls of said U-shaped structural section has a variable thickness progressively decreasing along the linear extension of each side wall from said common base to the respective distal end of each side wall, so as to guarantee greater flexibility and thereby better adherence of said two side walls on said inner and outer surface of the glass bell body in the zone of the respective lower edge;

wherein said U-shaped structural section, since being made of a deformable material, is such as to adhere perfectly to the flat surface of the dish, when said glass bell jar rests on said dish, thus improving the air tightness of the glass bell jar to the benefit of storage of the food inside the glass bell jar, wherein said two side walls are such as to perfectly adhere without forming any air spaces, along their linear extension from the common base to the respective distal end, on said inner and outer surface of the lower edge of the glass bell body;

wherein said U-shaped structural section is also made with the respective two side walls which have in section a configuration in which the two side walls converge slightly toward each other in the direction away from said common base, so that, when the U-shaped structural section is positioned on the lower edge of said glass bell body, said side walls are pushed slightly outwards, and thereby the spring-back of the plastic material they are made of is exploited to keep said two side walls adhering perfectly to said lower edge and prevent said U-shaped structural section from becoming detached from the bell jar during its use, whereby the U-shaped structural section becomes an integral part of the glass bell jar;

wherein the ends of the side walls of said U-shaped structural section have each a bevel, so as to allow drops of water, for instance caused by condensation, to flow outside said U-shaped structural section, when the glass bell jar is resting on the dish, whereby the drops of water do not end up between the lower edge of the glass bell body and the side walls of the U-shaped structural section; and wherein said glass bell body is designed such that the respective lower edge, when said glass bell jar rests on said dish, extends substantially perpendicular, along a vertical direction, to the horizontal flat surface of the dish, whereby, with said glass bell jar resting on said dish, also the two side walls of said U-shaped structural section adhering to the inner and outer wall of the lower edge of the glass bell body extend substantially perpendicular, along a vertical direction, to the horizontal flat surface of the dish and thereby are not into contact with the dish, and the base of said U-shaped structural section is interposed between the lower edge of the glass bell body and the dish so as to be into direct contact with the horizontal flat surface of the dish and thereby prevent said lower edge of the glass bell body from coming into contact with the dish.

2. A glass bell jar for the protection and/or storage of foods such as desserts and pies, as claimed in claim 1, wherein the plastic material said U-shaped structural section is made of is polypropylene.

3. A glass bell jar as claimed in claim 1, wherein the dish, on which said glass bell jar is designed to rest, is also made of glass.

4. A glass bell jar for the protection and/or storage of foods such as desserts and pies in combination with a dish, substantially flat, also made of glass, said glass bell jar being designed to rest on said dish, so as to cover the food contained in said dish, wherein said glass bell jar comprises:

a glass bell body with a lower edge; and a U-shaped structural member, made of soft deformable plastic material, that, when positioned on said lower edge, covers the lower edge of said glass bell body and prevents the lower edge from coming into direct contact with the upper surface of the dish, whereby, when said glass bell jar rests on said dish, said U-shaped structural member is interposed between the lower edge of the glass bell body and the dish and is into direct contact with the dish;

wherein said U-shaped structural member is comprised of a base with first and second ends, and two side walls that respectively extend from the first and second ends of the base and terminate at respective terminal ends, the two side walls adhering respectively to an inner and outer surface of the glass bell body at the respective lower edge, each of the two side walls having, in cross-section, an elongated configuration extending linearly from the respectively first and second ends of the base to the respective distal end with a variable thickness progressively decreasing along the linear extension from the base to the distal end so as to guarantee greater flexibility and thereby better adherence of each wall on a respective said inner and outer surface of the glass bell body at the respective lower edge;

wherein the base of said U-shaped structural member, since being made of soft material, is such as to adhere perfectly to the upper surface of the dish, when said glass bell jar rests on said dish, thus improving air tightness of the glass bell jar to benefit storage of the food inside the glass bell jar;

wherein said two side walls perfectly adhere on said inner and outer surface of the glass bell body at the respective lower edge without forming any air spaces between the inner and outer surface of the glass bell body at the respective lower edge and each side wall along the linear extension from the base to the distal end;

wherein the two side walls of the U-shaped structural member, when located separated from the bell jar, have a first distance from each other at the base and a smaller second distance from each other at the distal ends such that the two side walls converge slightly toward each other in the direction away from the base, so that, when the U-shaped structural member is positioned on the lower edge of said glass bell body, said side walls are pushed slightly outwards, and thereby spring-back of the plastic material keeps said two side walls adhering perfectly to said lower edge and prevent said U-shaped structural member from becoming detached from the bell jar during use, whereby the U-shaped structural member becomes an integral part of the glass bell jar;

wherein the distal ends of the side walls of said U-shaped structural member have each a bevel that allows drops of water to flow outside said U-shaped structural member when the glass bell jar is resting on the dish, such that drops of water do not end up between the lower edge of the glass bell body and the side walls of the U-shaped structural member;

wherein the plastic material said U-shaped structural member is made of is polypropylene; and wherein said glass bell body is designed such that the respective lower edge, when said glass bell jar rests on said dish, extends substantially perpendicular, along a vertical direction, to the horizontal surface of the dish, whereby, with said glass bell jar resting on said dish, also the two side walls of said U-shaped structural section adhering to the inner and outer wall of the glass bell body extend substantially perpendicular, along a vertical direction, to the horizontal flat surface of the dish and thereby are not into contact with the dish, and the base of said U-shaped structural member is interposed between the lower edge of the glass bell body and the dish so as to be into direct contact with the horizontal flat surface of the dish and thereby prevent said lower edge of the glass bell body from coming into contact with the dish.

* * * * *